US006029307A

United States Patent [19]

Baudoin

[11] Patent Number: 6,029,307

[45] Date of Patent: Feb. 29, 2000

[54] QUICK CONNECT BRUSH HANDLE AND MULTI-BRUSH KIT

[76] Inventor: Thomas Baudoin, 0 S 660 Kirk Ave., Elmhurst, Ill. 60126

[21] Appl. No.: 08/970,409

[22] Filed: Nov. 14, 1997

[51] Int. Cl.[7] ..... B25G 3/28

[52] U.S. Cl. ..... 15/145; 15/160; 15/176.1; 15/176.6; 132/120

[58] Field of Search ..... 15/145, 160, 176.1, 15/176.6; 132/120, 313; 403/321, 322.1, 326, 329

[56] References Cited

U.S. PATENT DOCUMENTS

| | | | |
|---|---|---|---|
| 490,831 | 1/1893 | Lohers | 15/176.6 |
| 1,702,042 | 2/1929 | Doskow | 15/176.6 |
| 2,421,647 | 6/1947 | Peterson | 15/180 |
| 2,648,082 | 8/1953 | Teetsel | 15/106 |
| 4,017,934 | 4/1977 | Callahan | 15/176.1 |
| 4,202,361 | 5/1980 | Bills | 132/123 |
| 4,328,604 | 5/1982 | Adams | 15/167.1 |
| 4,471,507 | 9/1984 | Schwartz | 15/176.6 |
| 4,811,445 | 3/1989 | Lagieski | 15/104.94 |

OTHER PUBLICATIONS

Modern Salon, Jul., 1997, p. 60.

*Primary Examiner*—Mark Spisich
*Assistant Examiner*—Theresa T. Snider
*Attorney, Agent, or Firm*—Patnaude & Videbeck

[57] ABSTRACT

A kit for aiding in the drying and curling of hair has a plurality of brushes which may be twisted into the hair and allowed to remain for a period of time to set a curl. Each of the brushes has a connector to which a handle can be removably attached such that a single handle can be used with all of the brushes in the kit.

17 Claims, 4 Drawing Sheets

QUICK CONNECT BRUSH HANDLE AND MULTI-BRUSH KIT

The present application relates to brushes and other devices of the type used by women for curling of hair, and in particular to a brush with a detachable handle.

BACKGROUND OF THE INVENTION

To provide curl to the hair, it is common to use curlers, brushes and other devices around which the hair is wrapped. The hair is treated with heat to relax it and break down chemical bonds affecting the hair. Cooling the hair allows it to set in a curled condition, and retain the curled configuration long after curlers or brushes have been removed.

Round brushes generally create a natural curl if the brush is left in the hair after drying and allowed to cool. Numerous round brushes can be used together to "set" the hair. However, depending on the orientation of the brush, the weight of the handle may distort the hair into an uneven curl. Also, the crowding caused by numerous brush handles sticking out of the hair may affect placement of additional brushes causing uneven curls.

It would be desirable to provide a more versatile hair brush which is also usable for curling hair. Such a brush might not only improve the efficiency of configuring the hair into curls, but also reduce the number and volume of instruments which would be carried by a traveler who seeks to provide curl to the hair.

SUMMARY OF THE INVENTION

Briefly, the present invention is embodied in a kit including a handle and a plurality of detachable brushes. In the preferred embodiment, each of the brushes has a core with a cylindrical outer surface. Extending radially outward from the outer surface of the core are a plurality of natural boar bristles, all having equal lengths such that the distal ends of the bristles define a cylinder. At one end of the cylindrical core is a generally conically shaped attachment end having an annular groove therein. The natural boar bristles, as a result of a natural positive charge, smooth the hair shafts and reduce static and frizziness. Synthetic bristles tend to be negatively charged, actually exacerbating static and frizziness problems with hair strands.

The handle is generally cylindrical in shape and has a first end with an axial bore therein sized to retain the conical attachment end of one of the brushes. Within the bore is an annular flange sized to fit within the annular groove of a brush to thereby retain the handle to the attachment end of the brush. The handle further has a plurality of radial slots around the end having a bore therein which divide the end of the handle into a plurality of elongate fingers. The fingers are made of a suitable plastic which is generally rigid but has a degree of flexibility such that the fingers can expand outward to allow the insertion or removal of the attachment end of the brush. The handle further has a slidable cylindrical latch movable from a first position in which it is positioned around the fingers at the first end of the handle to a second position where it is remote from the first end of the handle. When the latch is in the second position, the attachment end of a brush can be manually inserted into the bore of the handle or removed therefrom. When the latch is in the first position, however, the inner circumference of the cylindrical latch retains the inner flange of the handle in the grooves of the attachment end of the brush in a rubber-on-rubber orientation, locking the handle on the brush.

One seeking to employ the present invention to curl hair will first attach one of the brushes to the handle and with the latch in the first position use the brush to comb the hair to a desired orientation for curling. Thereafter, the brush with the handle attached will be twisted into the hair to curl hair strands around the cylindrical core and into the bristles of the brush. Next, the latch can be moved to the second position using only one hand and the handle detached from the first brush, leaving the first brush in the curled hair. The user then attaches the handle to a second brush and in similar fashion twists the second brush into the hair to form a second set of curls. It should be appreciated that a brush made of natural boar bristles has an inherent ability to retain the brush in the hair without the use of pins.

BRIEF DESCRIPTION OF THE DRAWINGS

A better understanding of the present invention may be had after a reading of the following detailed description taken in conjunction with the drawings wherein like numerals identify like elements, and in which.

DETAILED DESCRIPTION OF THE PREFERRED EMBODIMENT

Figure 1:
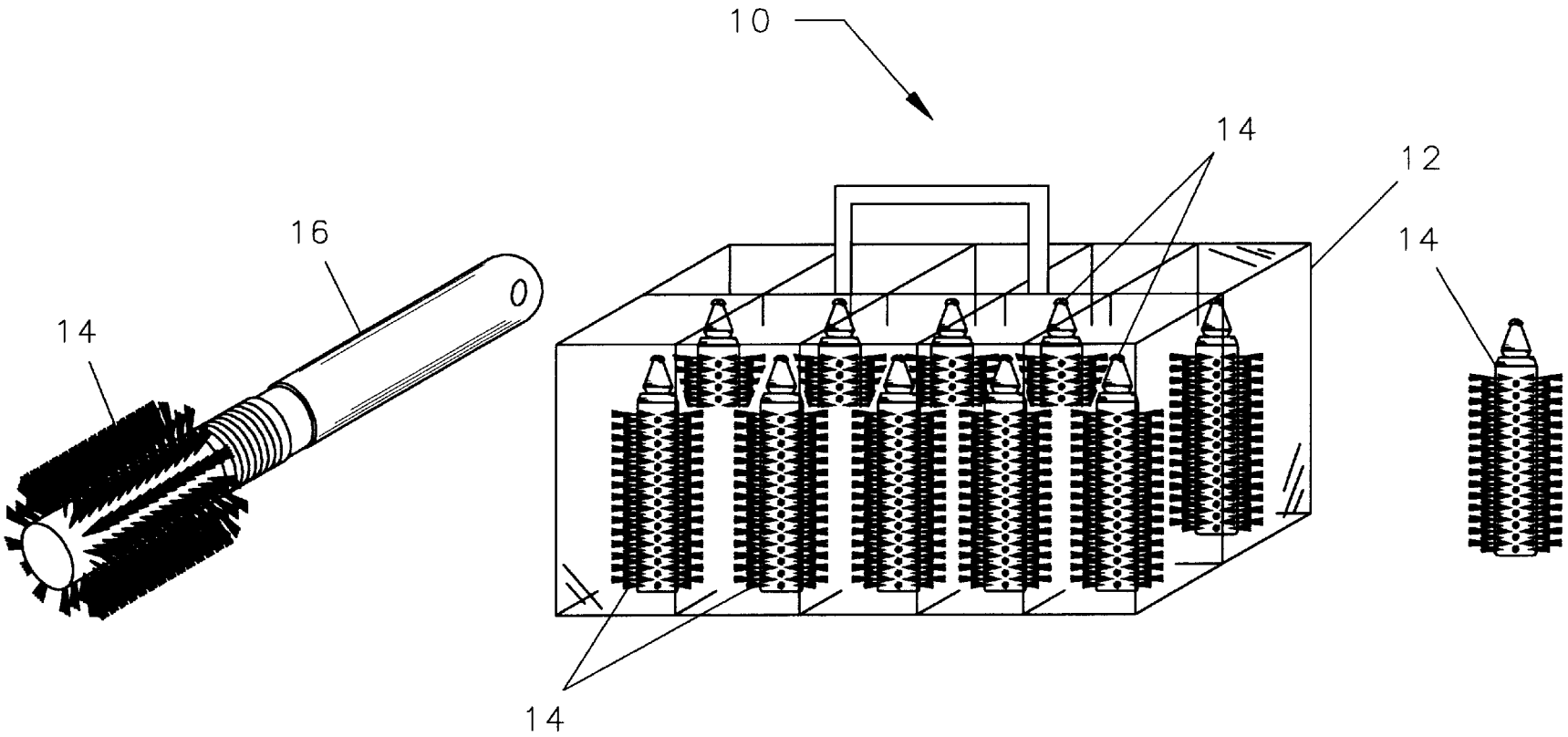
FIG. 1 is a perspective view of a kit having a plurality of brushes including a quick-connect handle constructed in accordance with the present invention.
Figure 2:
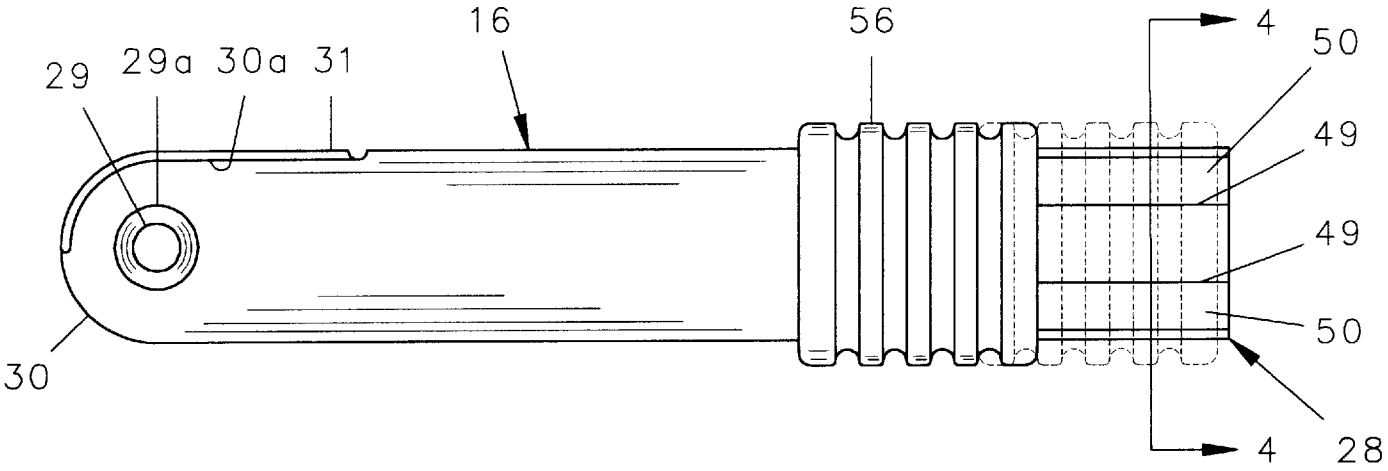
FIG. 2 is an enlarged side elevational view of a brush handle with the locking collar shown in the retracted position in solid lines, and in the extended position in dotted lines.
Figure 4B:
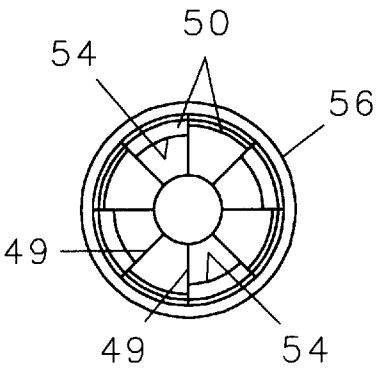
FIG. 4*b* is a cross-sectional view of the handle shown in FIG. 2 along line 4—4 thereof with the locking collar in the extended position.
Figure 4A:
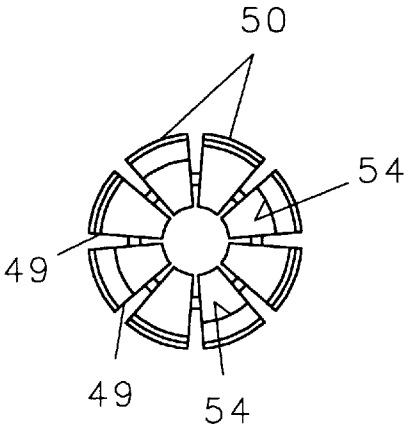
FIG. 4*a* is a cross-sectional view of the handle in FIG. 2 taken along line 4—4 thereof with the locking collar is retracted and the fingers are flared outward.

Referring to FIG. 1, the present invention is embodied in a kit 10 for grooming a user's hair which includes a transportable carrying container 12 adapted for retaining a plurality of re-usable cylindrical, preferably boar bristle, brushes 14 and a handle 16 which is quickly connectable-disconnectable to each of the brushes 14. Referring to FIGS. 1, 3 and 5*a*–5*d*, each of the brushes 14 includes a generally cylindrical core 18*a*–*d* at one end of which is an axially aligned frustoconical connector 20, preferably made of or coated with a rubber-like material. The frustoconical connector 20 has an annular groove 22 therein for receiving a flange from a handle as further described below. Extending radially outward from the outer surface of the core 18 are a plurality of natural boar bristles 24*a*–*d* all of which have substantially the same length such that the distal ends of the bristles 24*a*–*d* define a cylindrical outline to the brush. Also, the cylindrical core 18*a*–*d* has a diameter suitable for setting a curl to hair such that the brush 14 can be twisted into hair with the strands thereof wrapped around the core with the brush at least partially retained in the hair by the bristles 24*a*–*d*. As shown at 14*d*, the diameter of the brush 14*d* may be made larger or smaller depending on the tightness of curl desired. Additionally, as shown adjacent 14*c*, the length of the core 18*c* may be changed and the length of the bristles 24*c* may also be varied within the scope of the present invention.

Referring to FIGS. 2, 3, 4*a* and 4*b*, the handle 16 has a generally cylindrical body 26 having a first front end generally indicated at 28 and a second or rear end generally indicated at 30. The second end 30 is generally rounded or semispherical and includes a transverse hole 29 therethrough defining the inside of a hollow trunnion 29*a* on which a pivotable hair pick 31 is mounted. In its recessed position, hair pick 31 is nestled in a recess 30*a* in handle end 30 and can be pivoted outwardly to the dotted line position shown in FIG. 3 to allow the user to separate and lift groups of strands of hair as desired. The central portion 34 of the body 26 has a first diameter suitably sized for the human hand. Spaced from the first end 28 is a shoulder 36 where the diameter of the body 26 is reduced from the first diameter of the central portion 34 to a second smaller diameter of a collar retaining portion 38. Fitted around the first end 28 of the body and attached thereto by any suitable means such as an adhesive, is a female connector 40. The female connector 40 is generally tubular in shape with a cylindrical outer surface 42 and a central bore 44. The connector 40 has a first end with a countersink 46 therein and a second end 48. The countersink in the first end 46 is sized to receive the first end 28 of the body 26, and the parts are retained together by any suitable means such as an adhesive. Extending into the second end 48 are a plurality of longitudinal slots 49 which divide the second end 48 into a plurality of axially extending fingers 50—50, the outer surfaces of which define the cylindrical surface 42, the inner surfaces of which define the inner surface of the bore 44. The female connector 40 is made of a suitable rubber, plastic or other materials which have sufficient rigidity to retain the fingers 50—50 in the configuration of a cylinder, yet have sufficient flexibility so the distal ends of the fingers 50—50 may be radially deflected outward as hereinafter described.

The inner surfaces of the assembled fingers 50—50 define a frustoconical surface complementary to the shape of the frustoconical male connectors 20 of the brushes 14 and are preferably made of or coated with a rubber-like substance. Extending along the inner surfaces of at least some of the fingers 50—50 are transverse radially inwardly extending flanges 54—54. In the embodiment depicted, the second end 48 of connector 40 is divided into eight fingers 50—50, every other one of which has a flange 54 on the inner surface thereof. The flanges 54—54 on the fingers 50—50 define an annular ridge sized and positioned to be received within the groove 22 of the male connector 20 as shown in FIG. 3.

Fitted around the first end 28 of the body 26 and the connector 40 is a tubular collar 56 having an inner diameter sized to slidably fit over the outer surface 42 of the connector 40. The collar 56 has an inwardly extending annular flange 58 around one end thereof having an inner diameter which is less than the diameter of the outer surface 42, and greater than the outer diameter of the collar retaining portion 38 of the body 26 such that the collar 56 is slidable along the connector 40, and is movable between an extended position in which the flange 58 is against the connector 40 and a retracted position in which the flange 58 is against the shoulder 36.

A brush 14 can be attached to the handle 16 when the collar 56 is in the retracted position by inserting the male connector 20 thereof into the open end of the female connector 40. As the male connector 20 is inserted into the female connector 40, the flanges 58 will be forced radially outward by the insertion of the frustoconical connector 20 thereby deflecting outwardly the ends of fingers 50—50, until the flanges 58 snap into the groove 22 of the connector 20. After the flanges 52 have snapped into the groove 22, the mating rubberized surfaces 20, 50 create substantial surface friction therebetween to prevent slippage of the handle with respect to the brush during use. Next, the collar 56 can be moved to its extended position shown in broken lines in FIG. 2 wherein the fingers 50—50 are retained from being deflected outward, thereby preventing disconnection of the handle 16 from the brush 14. Once the brush has twisted the hair into the desired position, the collar 56 is moved to its retracted position and the connector 20 of the brush may be pulled out of the connector 40 of the handle 16. The handle 16 can then be positioned over the connector 20 of another brush 20 in the container 12 and attached thereto for further use.

Figure 3:
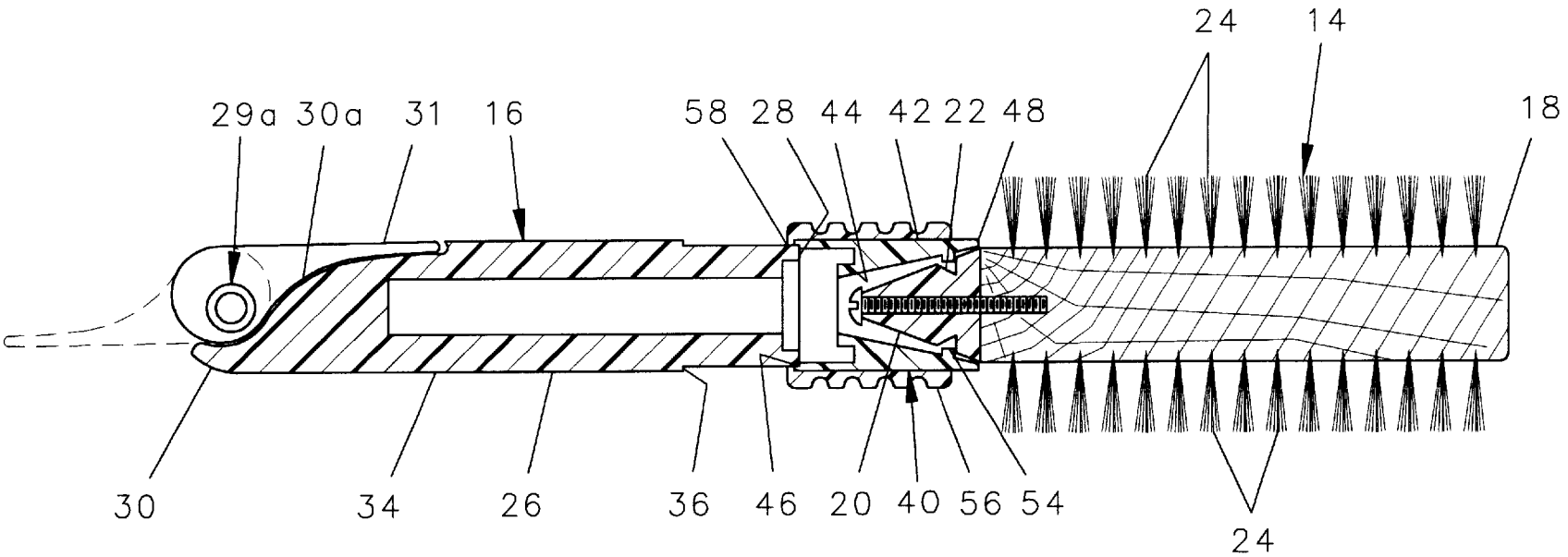
FIG. 3 is a cross sectional view of the handle shown in FIG. 2 with one of the brushes in the kit of FIG. 1 attached thereto.
Figures 5A, 5B, 5C, 5D:
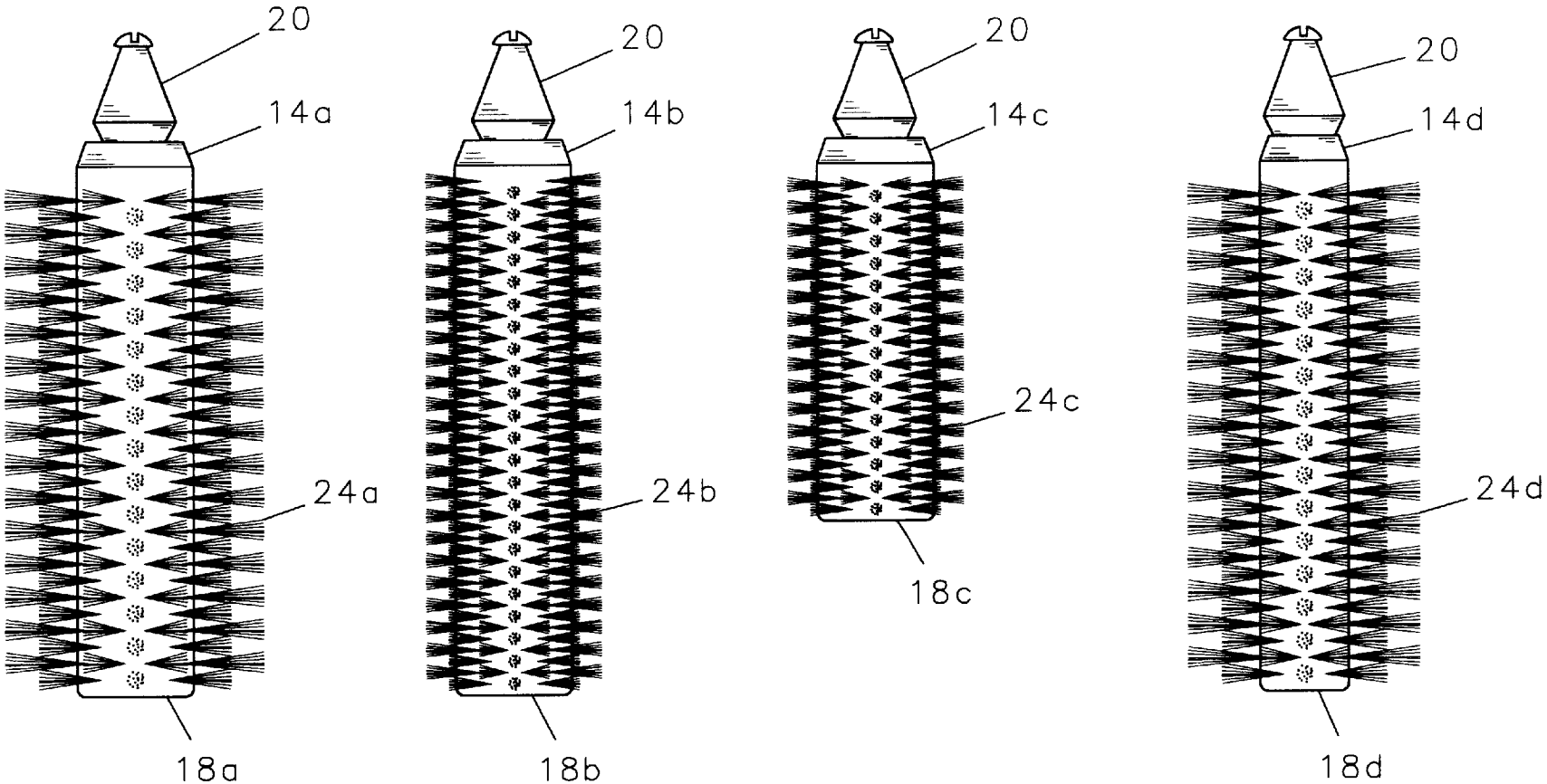
FIGS. 5*a*–5*d* depicts a typical assortment of sizes of brushes which may be used as desired to make up the kit shown in FIG. 1.

While the embodiment shown in FIG. 3 discloses a wood core brush, it will be understood that the core may be made of plastic, metal or other materials. Also, while natural boar bristles are preferred, other bristles including velcro or synthetic materials may be utilized. The quick connect handle may also be utilized, within or outside of a kit, with paddle brush heads, Denman brush heads and vent type brushes, and wide tooth comb heads.

While one embodiment of the present invention has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed is:

1. A hairstyling brush kit having individual brushes and a detachable handle for aiding in rolling the brushes into a user's hair, said kit comprising in combination, a plurality of said brushes, each of said brushes having a central core with a plurality of bristles extending radially therefrom defining a generally round hairstyling brush, each of said brushes having a connector at one end of said core, a detachable handle for use in connection with said plurality of brushes, attachment means including a plurality of axially extending flexible fingers on said handle for removably attaching said handle to each of said connectors of said plurality of brushes, one at a time.

2. A kit comprising in combination, a plurality of brushes, each of said brushes having a core with a plurality of bristles extending radially therefrom, each of said brushes having a connector at one end of said core, said connector being generally conical in shape, a handle, attachment means including a plurality of axially extending flexible fingers on said handle for removably attaching said handle to one of said connectors of one of said plurality of brushes.

3. A kit in accordance with claim 2 wherein one of said connector and said attachment means has an annular groove and the other of said connector and said attachment means has a flange for engaging said groove when said handle is removably attached to one of said brushes.

4. The kit in accordance with claim 2 wherein said attachment means further comprises a collar movable from a first position in which said handle is locked to a brush having a connector inserted therein to a second position in which said handle is unlocked from a brush having a connector inserted therein.

5. The kit as defined in claim 2 wherein at least one of said plurality of brushes has a body length differing from the body lengths of the others of said plurality of brushes.

6. The kit as defined in claim 2 wherein all the brushes of said plurality of brushes have the same body lengths.

7. The kit as defined in claim 2 wherein at least one of said plurality of brushes has bristles differing in length from the length of bristles of the others of said plurality of brushes.

8. The kit as defined in claim 2 wherein all the brushes of said plurality of brushes have the same length bristles.

9. The kit as defined in claim 2 wherein at least one of said plurality of brushes has a core diameter that differs from the core diameters of the others of said plurality of brushes.

10. The kit as defined in claim 2 wherein all of the core diameters of said plurality of brushes are identical.

11. The kit in accordance with claim 2 wherein said plurality of brushes are made of natural boar bristles.

12. A hair brush comprising, a brush core having a plurality of bristles extending therefrom, said brush core having a frustoconical end portion, said frustoconical end portion having an annular groove thereon, a brush handle having a connecting end for detachably connecting to said frustoconical end portion, said connecting end comprising a plurality of flexible fingers extending axially therefrom, said fingers having inner surfaces, a tubular collar slidable around said connecting end and said fingers from a first position wherein said ends of said fingers are retained against being deflected radially outward and a second position wherein said ends of said fingers are not retained against being deflected radially outward, and an annular flange on one of said frustoconical end portion and said inner surfaces and a complementary annular groove on the other of said frustoconical end and said inner surfaces, whereby said annular flange is retained in said annular groove for locking said brush handle into said brush core when said tubular collar is in said first position and said fingers are deflected radially outward for disconnecting said brush handle from said core when said tubular collar is in said second position.

13. The hair brush as defined in claim 12 and further comprising means for retaining said tubular collar from sliding off said handle.

14. The hair brush as defined in claim 12 wherein said annular groove is on said frustoconical end portion and said annular flange is on said inner surfaces.

15. The hair brush as defined in claim 12 wherein said brush handle further includes a hair pick pivotally mounted adjacent a distal end thereof for parting sections of hair prior to rolling same.

16. A quick connect-disconnect hair brush comprising:

a handle sized to be comfortably grasped by a user, said handle having a distal end and an opposing female connection end, said female connection end including an annular sleeve thereover that is movable axially therealong, a brush including a central core having a plurality of flexible members extending radially therefrom, and a male connection at one end thereof shaped for mating engagement with said female connection end of said handle, and axial movement of said annular sleeve along said handle providing a quick connect-disconnect function for engaging or disengaging said handle on said brush.

17. A quick connect-disconnect hair brush comprising:

a handle sized to be comfortably grasped by a user, said handle having a distal end and an opposing end including one of a male and a female connection end, a brush including a central core having a plurality of flexible members extending radially therefrom, and the other of a male and a female connection at one end thereof shaped for mating engagement with the other of said male and female connection ends on said handle, said female connection end including an annular sleeve thereover that is movable axially therealong, and axial movement of said annular sleeve along said female end providing a quick connect-disconnect function for engaging or disengaging said handle on said brush.

* * * * *